US005651526A

United States Patent [19]

Spinner

[11] Patent Number: 5,651,526

[45] Date of Patent: Jul. 29, 1997

[54] SOCKET MEMBER FOR LOCATING A ROD, FOR USE IN A DISPLAY PLATFORM OR THE LIKE

[75] Inventor: David Spinner, Thornhill, Canada

[73] Assignee: Wm. Prager Ltd., Toronto, Canada

[21] Appl. No.: 433,847

[22] Filed: May 2, 1995

[51] Int. Cl.[6] ..... F16M 11/20; D06C 15/00

[52] U.S. Cl. ..... 248/519; 248/511

[58] Field of Search ..... 223/57, 66, 68, 223/70; 248/511, 512, 519, 222.12, 223.31, 224.7, 346.04

[56] References Cited

U.S. PATENT DOCUMENTS

| | | | |
|---|---|---|---|
| 3,009,284 | 11/1961 | Ryan | 223/66 X |
| 3,082,778 | 3/1963 | Cole | 248/511 X |
| 3,168,227 | 2/1965 | Osmond | 223/66 |
| 3,215,381 | 11/1965 | Ching | 248/519 X |
| 3,234,689 | 2/1966 | Ryan | 223/68 X |
| 3,362,593 | 1/1968 | Cram et al. | 223/68 |
| 3,484,359 | 12/1969 | Greene et al. | 248/512 X |
| 3,908,946 | 9/1975 | George et al. | 248/519 X |
| 5,265,779 | 11/1993 | Jiang | 223/66 X |

FOREIGN PATENT DOCUMENTS 2227165 7/1990 United Kingdom .

*Primary Examiner*—Terry Lee Melius
*Assistant Examiner*—Robert Pezzuto
*Attorney, Agent, or Firm*—Bereskin & Parr

[57] ABSTRACT

A socket member for mounting in the upper surface of a platform includes two O-rings or other resilient retaining members. The socket member defines an elongate bore into which a rod is inserted. The O-rings serve to locate the rod, accommodate any tolerances, and ensure that the rod is not loose within the bore. The socket member can comprise upper and lower socket members which screw together. The upper socket member can be secured by a nut to the surface of the platform. The device can be used to mount mannequins, other display fixtures and the like which have rods secured to them.

13 Claims, 4 Drawing Sheets

SOCKET MEMBER FOR LOCATING A ROD, FOR USE IN A DISPLAY PLATFORM OR THE LIKE

FIELD OF THE INVENTION

This invention relates to display stands and the like, and more particularly is concerned with display platforms which provide a number of different positions for mounting a mannequin or the like.

BACKGROUND OF THE INVENTION

Mannequins are mounted in a variety of different ways. One simple technique is to arrange the mannequin in the desired pose and then place it on a flat, horizontal surface. This has the advantage of simplicity and enables the mannequin to be placed in any desired position.

Its great disadvantage is that it limits the positions in which the mannequin can be put, since it must necessarily be in a balanced position. Further, if the mannequin is in any sort of exposed location, it can be easily knocked over or dislodged. In particular, if the mannequin is positioned so that its centre of gravity is not evenly centered above, say, the feet of the mannequin, then it may be relatively easily dislodged or knocked over. For this reason, support or display platforms are often provided which include a number of vertical or holes or bores. Mannequins are then provided with corresponding rods, for example, a rod could be secured to each foot of the mannequin, which are then inserted into these holes. This then assists in securing the mannequin in position and prevents it from being dislodged sideways in particular.

It is often desirable to provide a mannequin on a support platform which is wheeled so that it can be moved around. Where it is desired to move the platform or the mannequin, it is almost always inadequate to have the mannequin simply placed on a flat horizontal surface. Accordingly, such wheeled platforms are routinely provided with bores for receiving corresponding rods attached to the mannequin.

Now, both for ease of use and assembly, and also for simplicity and economy in manufacture, the bores in such a platform and the rods attached to a mannequin are not manufactured to tight tolerances. Rather, it is common for there to be a reasonable amount of play between the rod and the bore. This facilitates insertion of the rod. However, it does have the disadvantage that the mannequin is not securely located and can move around a certain extent. Now, the positioning and posing of a mannequin is a skilled craft. Commonly, stores will have trained individuals or teams of people who will travel around a group of stores, rearranging window displays, mannequins etc. Once such a skilled person has arranged a mannequin it is desirable that the set pose be maintained. If it is only dislodged slightly, the overall effect and appearance can be markedly altered. Often, unskilled sales staff will be unable to restore the mannequin to it original position. In the case of wheel platforms, these may be moved between different locations, so as to be subject to slight inclinations from the horizontal. This again can result in the mannequin being dislodged and not retaining its original position.

Presently, there is an increasing trend to use different supports and shapes, instead of mannequins, which accurately resemble a human form. There are many supports for cloths which simply resemble abstract shapes, or elaborate clothes hangers. It is also often desirable to provide additional items or artifacts, as a background to a display. Such items may be shelves and the like and would not necessarily support or display clothes. All such items and artifacts need to securely bounded, and are suitable for mounting by way of rods in holes or bores of a support platform.

Accordingly, present techniques for securely mounting mannequins and the like are inadequate, and do not securely hold a mannequin in a desired pose.

SUMMARY OF THE PRESENT INVENTION

Accordingly, it is desirable to provide a platform for a mannequin or other support, which provides a number of different positions for a supporting device, which securely holds a supporting device in a desired position, without any unnecessary play, but which at the same time enables the platform to be produced simply and economically.

In accordance with the present invention, there is provided a socket assembly for use in a platform for holding supporting rods, the socket assembly comprising: a socket member including upper and lower internal annular grooves; means for mounting the socket member to a platform; an elongate bore extending through the socket member, for receiving the supporting rod; and annular resilient location means provided within the bore, the annular resilient location means comprising both upper and lower resilient members mounted in the upper and lower internal grooves respectively, wherein the spacing between the supporting rod and the socket member is substantially less than the width of the rod and wherein the annular resilient members are axially spaced apart by a distance substantially greater than the width of the elongate bore, for locating a rod within the bore.

Conveniently, the means for mounting the socket member to the platform comprises an external thread on the socket member, a head on the socket member for abutting one side of an upper surface of a platform, and a cooperating threaded member, for example a nut, for abutting the other side of the surface to clamp the surface between the head and the threaded member.

Preferably, the socket member comprises upper and lower socket members, the upper socket member includes the upper internal annular groove and is adapted to cooperate with the means for mounting the socket member to a platform, the lower socket member includes the lower internal annular groove, and the upper and lower socket members include means for securing the lower socket member to the upper socket member.

The upper socket member can include a main body portion provided with the external screw thread, wherein the head is circular and has a larger diameter than the main body portion, whereby, in use, the upper surface of a platform can be sandwiched between the head and the nut, and the upper socket member then includes an internal bore extending through the head and the main body portion.

Preferably, the lower socket member comprises an elongate tubular member defining an internal bore having an internal diameter corresponding to the diameter of the internal bore of the upper socket member, wherein at least an upper portion of the lower socket member includes an internal screw thread corresponding to the external screw thread of the upper socket member.

The lower and upper socket members can each include a transverse bore, for engagement by a tool to facilitate screw attachment.

In accordance with another aspect of the present invention, there is provided a socket member in combination with a platform including an upper surface, wherein the head on the socket member abuts one side of the upper surface, and the cooperating threaded member abuts the other side of the upper surface to clamp the upper surface between the head and the threaded member.

BRIEF DESCRIPTION OF THE DRAWING FIGURES

For a better understanding of the present invention and to show more clearly how it may be carried into effect, reference will now be made, by way of example, to the accompanying drawings, which show a preferred embodiment of the present invention and in which.

DESCRIPTION OF PREFERRED EMBODIMENT

Figure 1:
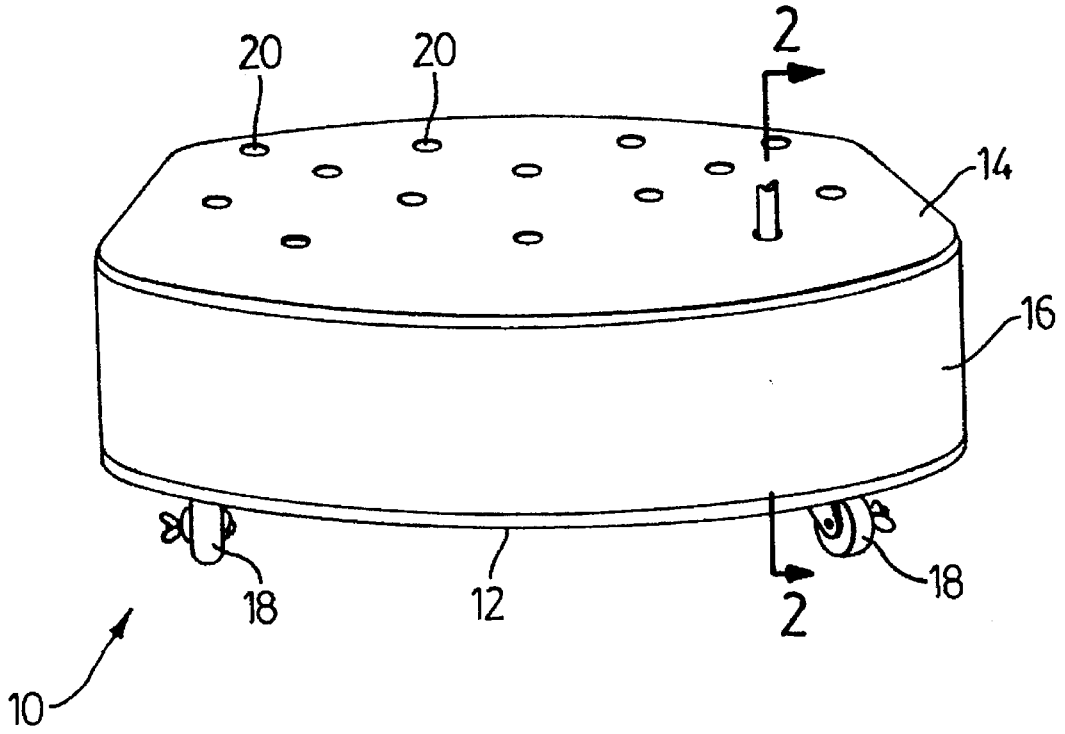
FIG. 1 is a perspective view of a platform in accordance with the present invention.

Referring to the drawings, a display or support platform is generally designated by the reference 10. The platform 10, in known manner, is hollow, and comprises a base 12, an upper surface 14 and sidewalls 16 supporting the upper surface 14 above base 12. Wheels 18, which can be caster wheels, are secured to the bottom of base 12, to enable the platform 10 to be rolled around between different, desired locations.

In the upper surface 14, there is an array of holes 20. The holes 20 are formed, in this embodiment, in a generally triangular array. The exact orientation and spacing of the holes 20 can be chosen as desired.

Figure 2:
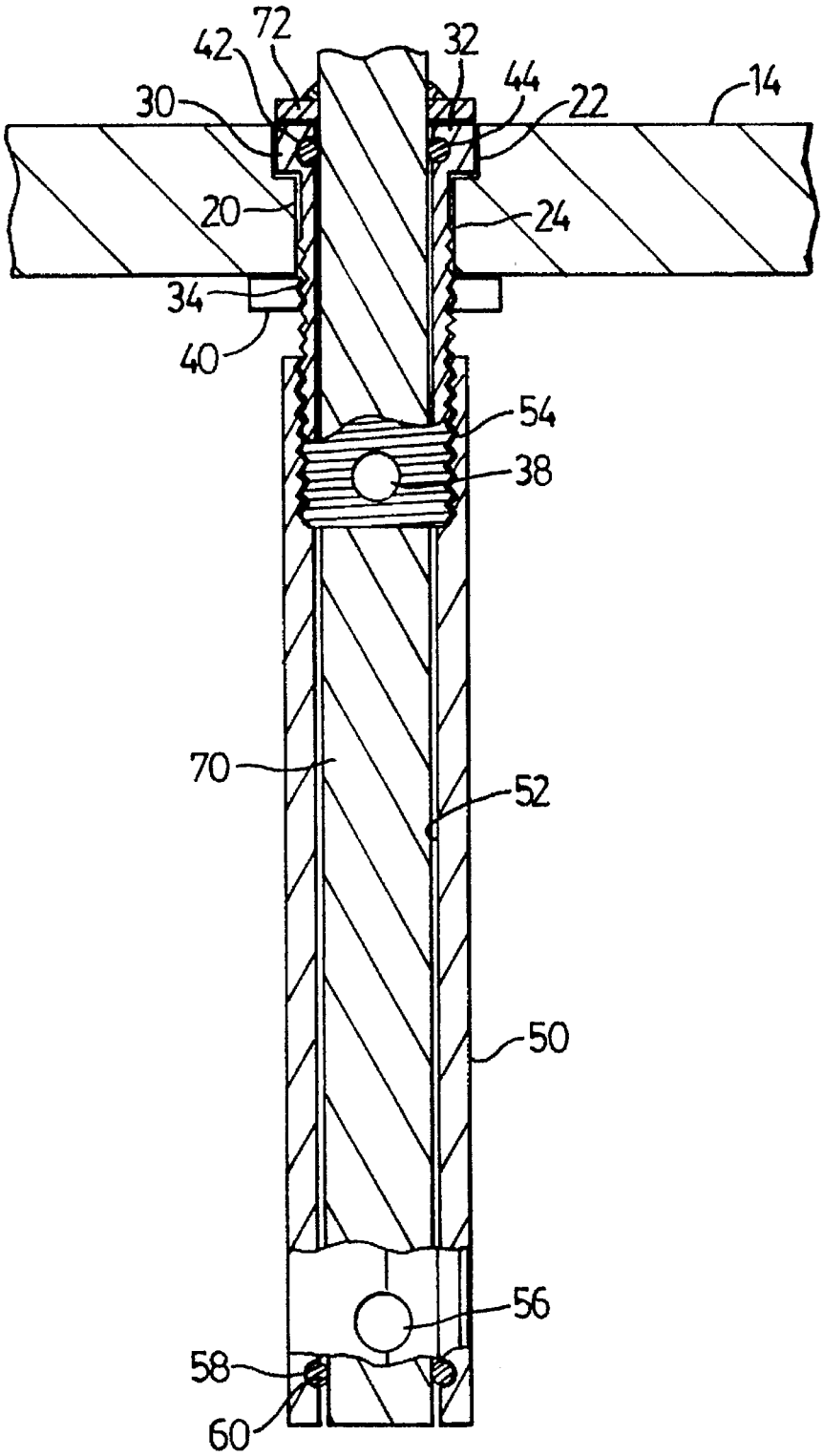
FIG. 2 is a sectional view showing details of a single hole and socket assembly of the present invention.
Figure 3:
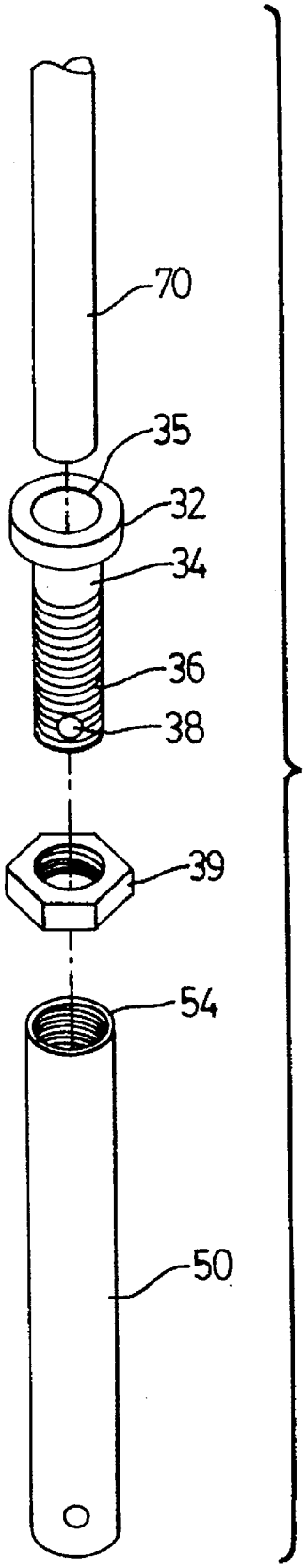
FIG. 3 is a perspective, exploded view of the socket assembly in accordance with the present invention.

Referring now to FIG. 2, each hole 20 is circular and comprises an upper portion 22 of relatively large diameter and a lower portion 24 of relatively small diameter. Here, the upper portion 22 has a diameter of 1-inch and an axial extent of ¼-inch, while the lower portion 24 has a diameter of ¾ of an inch and an axial extension of ½-inch; the depth or thickness of the upper surface 14 is ¾-inch.

The socket assembly of the present invention has an upper socket member 30 formed generally in the manner of a screw element. That includes a head 32 which has a diameter 1-inch and an axial extent of ¼-inch for fitting within the upper portion of a hole 20. Extending downwardly from the head 32 is a main body portion 34 which has a length of 1¾-inches, to give the upper socket member 30 an overall length of 2-inches. The lower 1½-inches of the body portion 34 is threaded, as indicated at 36, and a transverse bore 38 is provided. The bore 38 is located ¼-inch from the bottom of socket member 30 and has a diameter of ¼-inch.

The upper socket member 30 defines an internal, main bore 35 with an internal diameter of 0.635 inches, while the external diameter of the main body portion 34 is ¾-inch for fitting within the lower portion 24 of one of the holes 20.

Each of the holes 20 is provided with an upper socket member 30 with its head received in the upper portion 22 and main body portion 34 extending downwardly below the upper surface 14. A nut 40 is used to secure each socket member 30 in position. The purpose of the transverse bore 38 is to enable a screwdriver or the like to be fitted within that bore 38, to hold the socket member 30 against rotation, while the nut 40 is tightened in position. The head then abuts the top of the upper surface 14, while the nut 40 abuts the bottom of that surface, to clamp the socket assembly in position.

Now, in accordance with the present invention, each upper socket member 30 includes, in the head 32, an internal annular groove 42, which has a rectangular cross-section, for receiving an O-ring 44. The O-ring has an internal diameter of ⅝-inch for reasons which are explained below.

After fitting each upper socket member 30, a lower socket member 50 is fitted thereto. Each lower socket member 50 is in the form of an elongate tube and includes an internal bore 52 of ⅝-inch diameter. As indicated at 54, the top ¾-inch of the bore 52 is bored out to a diameter of ¾-inch and threaded, corresponding to the external thread of the upper socket member 30. The socket member 50 has an overall length of 5¼-inches. At the bottom of the socket member 50, there is a transverse bore 56, formed by opposing apertures; the apertures again have a diameter ¼-inch and here are spaced ½-inch from the bottom of the socket member 50.

Between the transverse bore 56 and the bottom of the socket member 50, located ¼-inch from the bottom is an internal annular groove 58. This again has a rectangular section. An O-ring 60 is located in this groove 58 and has an internal diameter of ⅝-inch. It will be appreciated that the O-rings 44, 60 have the same internal diameter, namely ⅝-inch.

To secure each socket member 50 in position, a screwdriver or the like is inserted through the bore 56 and is used to tightened the socket member 50 to the bottom of a respective upper socket member 30. Approximately ¾-inch of the socket members 30, 50 will then be engaged with one another, giving an overall length for the combined socket member of 6½-inches.

Referring back to FIG. 1, the platform 10 has an overall height of 10-inches. It will thus be appreciated that the bottom of the socket member 50 is spaced by a few inches above the base 12 at an exact distance depending upon the thickness of a base 12.

In use, as shown, a mounting rod 70 having an external diameter of ⅝-inch, is inserted into a selected socket member, comprising the upper and lower socket members 30, 50. (In known manner, suitable clearance is provided between the rod and the bore in the socket member) The rod 70 includes a collar 72 located 6½ inches from the bottom end. The collar 72 is here shown as having the same size as the upper portion 22, but it will be appreciated that the collar can be of any size indeed, the collar can be an integral part of the device or display attached to the rod 72. The rod 70 is slid down through the bore of the socket member until the collar 72 comes to rest against the upper surface 22. The bottom of the rod 70 is then flush with the bottom of the socket member 50.

The O-rings 44, 60 serve to securely locate the rod 70 in position. Additionally, the O-rings serve to accommodate any difference in tolerances between the internal bore of the socket member and the external diameter of the rod 70. They also provide a certain resilient or cushioning effect, to accommodate small shocks, vibration, etc. The dimensions are such that the spacing between the supporting rod on the socket member is substantially less than the width of the rod and the annular resilient members are axially spaced apart by a distance substantially greater than the width of the elongate bore in the socket member. It can be noted that the diameter of the cross section of the O-rings, in their normal state, is substantially greater than the difference in the diameters of the elongate bore and the rod 70. This then ensures that any display secured to the rod 70 is securely located and not subject to any unwanted movement. For example, where a mannequin has a pair of rods 70 secured to the feet of the mannequin, this would ensure that the mannequin, once positioned, is securely located, and should not be dislodged.

It will be appreciated that while a preferred embodiment of the invention has been described, numerous variations are possible. For example, while O-rings have been described, any suitable resilient biasing means can be provided. Short sleeves of resilient or other material or the like could be provided. Further, while the socket member is provided with separate upper and lower socket members, it is conceivable that a single, unitary socket member could be provided. It could then include grooves for O-rings, which could then be of similar dimensions.

Figure 4:
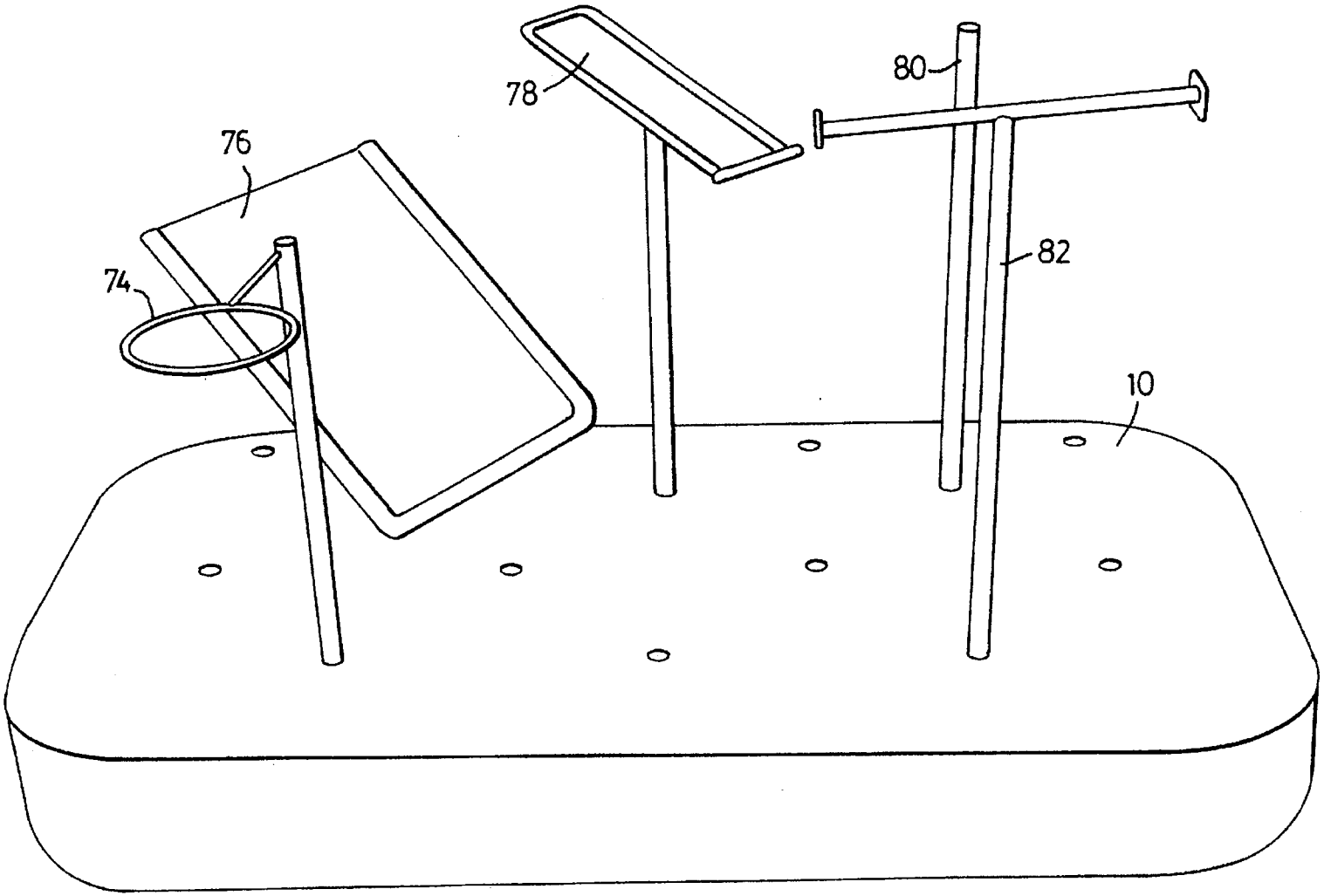
FIG. 4 is a perspective view of a platform showing different items mounted by a socket assembly according to the present invention.

FIG. 4 shows how different items can be mounted by the socket assembly. This Figure shows a vase holder 74, shelf 76 for displaying shirts, another shelf 78 dimensioned for shoes, a plain rod at 80 and a T bar 82, which can be used for bracelets or other jewellery, ties, etc. It will thus be realized that the socket assembly of the present invention can be used for a variety of different purposes.

I claim:

1. A socket assembly for use in a platform for holding a supporting rod, the socket assembly comprising: a socket member including upper and lower internal annular grooves; means for mounting the socket member to a platform; an elongate bore extending through the socket member, for receiving said supporting rod; and annular resilient location means provided within the bore, for locating a rod within the bore, the annular resilient location means comprising upper and lower resilient members mounted in the upper and lower internal annular grooves respectively wherein the spacing between the supporting rod and the socket member is substantially less than the width of the rod and wherein the annular resilient members are axially spaced apart by a distance substantially greater than the width of the elongate bore.

2. A socket member as claimed in claim 1, wherein each annular resilient member has a generally circular cross-section.

3. A socket member as claimed in claim 1, wherein the means for mounting the socket member to the platform comprises an external thread on the socket member, a head on the socket member for abutting one side of an upper surface of a platform, and a cooperating threaded member for abutting the other side of the surface to clamp the surface between the head and the threaded member.

4. A socket member as claimed in claim 1, which comprises upper and lower socket members, wherein the upper socket member include the upper internal annular groove and is adapted to cooperate with the means for mounting the socket member to a platform, wherein the lower socket member includes the lower internal annular groove, and wherein the upper and lower socket members include means for securing the lower socket member to the upper socket member.

5. A socket member as claimed in claim 4, wherein the means for mounting the socket member comprises an external thread on the upper socket member, a head on the socket member for abutting one side of a surface of a platform, and a nut for engaging the external thread for clamping the surface between the head and the nut.

6. A socket member as claimed in claim 5, wherein the upper socket member includes a main body portion provided with the external screw thread, wherein the head is circular and has a larger diameter than the main body portion, whereby, in use, the upper surface of a platform can be sandwiched between the head and the nut, and wherein the upper socket member includes an internal bore extending through the head and the main body portion.

7. A socket member as claimed in claim 6, wherein the lower socket member comprises an elongate tubular member defining an internal bore having an internal diameter corresponding to the diameter of the internal bore of the upper socket member, wherein at least an upper portion of the lower socket member includes an internal screw thread corresponding to the external screw thread of the upper socket member.

8. A socket member as claimed in claim 7, wherein the lower and upper socket members each includes a transverse bore, for engagement by a tool to facilitate screw attachment.

9. A socket member as claimed in claim 3, in combination with a platform including an upper surface, wherein the head on the socket member abuts one side of the upper surface, and the cooperating threaded member abuts the other side of the upper surface to clamp the upper surface between the head and the threaded member.

10. A socket member as claimed in claim 9, wherein the socket member comprises upper and lower socket members, wherein the upper socket member include the upper internal annular groove and said head and is adapted to cooperate with the means for mounting the socket member to a platform, wherein the lower socket member includes the lower internal annular groove, and wherein the upper and lower socket members include means for securing the lower socket member on the upper socket.

11. A socket member as claimed in claim 5, in combination with a platform including an upper surface, wherein the head on the socket member abuts one side of the upper surface, and the upper surface is clamped between the head and the nut.

12. A socket member as claimed in claim 11, wherein the upper socket member includes a main body portion provided with the external screw thread, wherein the head is circular and has a larger diameter than the main body portion, wherein the upper socket member includes an internal bore extending through the head and the main body portion, wherein the upper surface includes a hole, in which the socket assembly is mounted, the hole having an upper portion with a diameter corresponding to the diameter of the head and a lower portion having a diameter corresponding the diameter of the main body portion of the upper socket member.

13. A socket member as claimed in claim 2, wherein the rod and the elongate bore are both of circular cross-section and wherein the elongate bore and the rod both have a generally circular cross-section and wherein the diameter of the circular section of each resilient member is substantially greater than the difference between the diameters of the elongate bore and the rod.

* * * * *